US007619353B2

(12) United States Patent
Yan

(10) Patent No.: US 7,619,353 B2
(45) Date of Patent: Nov. 17, 2009

(54) COMPACT FLUORESCENT SPRINGLAMP

(75) Inventor: Zhaoling Yan, Shanghai (CN)

(73) Assignee: Shanghai Zhenxin Electronic Engineering Co., Ltd., Shanghai (CN)

( * ) Notice: Subject to any disclaimer, the term of this patent is extended or adjusted under 35 U.S.C. 154(b) by 299 days.

(21) Appl. No.: 11/481,898

(22) Filed: Jul. 7, 2006

(65) Prior Publication Data

US 2007/0188101 A1 Aug. 16, 2007

(30) Foreign Application Priority Data

Feb. 10, 2006 (CN) ..... 2006 2 0039422 U

(51) Int. Cl.
*H01J 61/33* (2006.01)

(52) U.S. Cl. ..... 313/493; 313/634; 313/318.05

(58) Field of Classification Search ..... None
See application file for complete search history.

(56) References Cited

U.S. PATENT DOCUMENTS 5,128,590 A * 7/1992 Holzer ..... 315/58
6,204,602 B1 * 3/2001 Yang et al. ..... 315/58
6,316,872 B1 * 11/2001 Ge et al. ..... 313/493
6,494,730 B1 * 12/2002 Yan ..... 439/226
6,515,433 B1 * 2/2003 Ge et al. ..... 315/227 R
7,053,540 B2 * 5/2006 Bobel ..... 313/318.1
2005/0116604 A1 * 6/2005 Bobel ..... 313/318.1

FOREIGN PATENT DOCUMENTS

CN 2836232 11/2006

* cited by examiner

*Primary Examiner*—Ashok Patel
(74) *Attorney, Agent, or Firm*—Baker & Hostetler LLP

(57) ABSTRACT

It's about a new kind of fluorescent springlamp, which includes lamp base (1), lower part of a housing (2), upper cover for the housing (3), spiral lamp tube (4), and a PCB that placed inside the housing (5). Among them, the legs of the tube with filaments in them are straight. There are two notches on the PCB, and two holes on the upper cover of the housing as well, so the straight legs of the tube can be placed in the housing. Moreover, the length of the straight legs of the tube can be longer than the distance between the PCB in the housing and the facing surface of the upper cover for the housing. This method can greatly reduce the overall height of the lamp and reduce the operating temperature in the housing, which increased the working efficiency of the lamp and prolonged the lamp life.

2 Claims, 5 Drawing Sheets

COMPACT FLUORESCENT SPRINGLAMP

CROSS-REFERENCE TO RELATED APPLICATIONS

This application claims priority of Chinese Patent Application No. 200620039422.0, filed Feb. 10, 2006, now pending, the disclosure of which is hereby incorporated by reference in its entirety.

FIELD OF THE INVENTION

This invention is for a fluorescent lamp with a spiral tube, which can not only reduce the overall height of the lamp, but also can make the diameter of the lamp base less than the diameter of the spiral tube part of the lamp.

BACKGROUND OF THE INVENTION

The popular springlamp is showed in the attached FIG. 7. Although this configuration doesn't have the national standard, it is mass produced in China, and sells mainly to United States. This design is recognized by the market for its strong bulb, compact and nice shape and high light efficiency. However there are some defects of this design, as the filament base make the straight part of the tube leg much longer, thus increasing the overall height of the lamp up to 20 mm. Moreover, the bigger the diameter of the tube, the longer the straight tube leg would become. Then there is no superiority for the springlamp regarding the overall length of the lamp.

In addition, seen from FIG. 7, it is well-known that like other 2U and 3U compact fluorescent lamps, the tube ends (sealing end) with a high working temperature are placed in the bottom of the PCB, so the bottom of the tube is heated and the temperature is very high. The operating character would decrease as well, result in shortened life of the lamps. People once tried to increase the distance between the tube legs longer than the PCB, but this brought out serious problems of matching with normal lamp fixtures. We brought forward the patent 200520044105.3, with the purpose of improving the structure of spinglamp. There are two notches on the PCB with a base that can hold the two tube legs of the lamp. Moreover, the length of the straight part of the tube can be longer than the distance between the PCB in the plastic housing and the top of the housing. This method can greatly reduce the overall height of the lamp. In addition, as the. PCB is placed beside the straight part of the tube in the housing, it can also reduce the bad effect on the components on the PCB by the heat from the straight part of the lamp, which increased the working efficiency of the lamp and prolonged the lamp life. However, there are still another problem, that is, the diameter of the plastic housing must be bigger than the diameter of the spiral tube part of the lamp. To solve this problem and to make our products more compact and more adaptable, we made the following invention:

SUMMARY OF INVENTION

To solve the problems described above, this invention provides us a kind of springlamp, which includes lamp base (1), lower part of the housing (2), upper cover for the housing (3), spiral lamp tube (4), the PCB that placed inside the housing (5) and some other components. The legs of the tube with filaments in them are straight. It makes two notches on the edge of the PCB (See FIG. 6), and two holes on the upper cover of the housing to completely put the straight part of the tube in the housing. By using this method, the diameter of the housing can be less than the diameter of the spiral tube part of the lamp. The bad effect to the components on the PCB by the heat from the straight part of the lamp is reduced. Therefore, the working efficiency of the lamp is increased and the life of the lamp is increased as well. Of course we should arrange the components in PCB more carefully due to relatively small board area but it is still the prior arts.

BRIEF DESCRIPTION OF THE DRAWINGS

Following is the detailed description of the attached figures.

Figure 1:
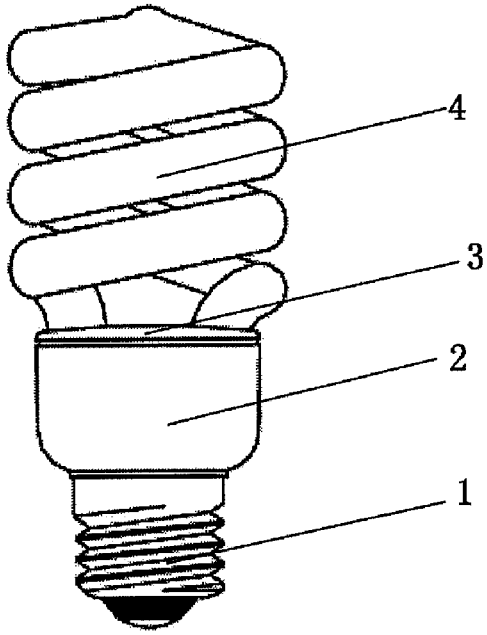
FIG. 1, FIG. 2 and FIG. 3 and FIG. 4 are the front view, left view, down view and up view of the lamp respectively.
Figure 2:
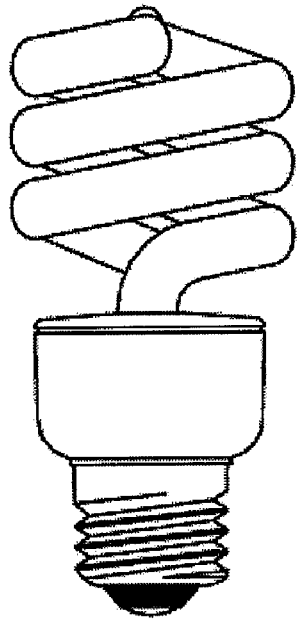
Figure 3:
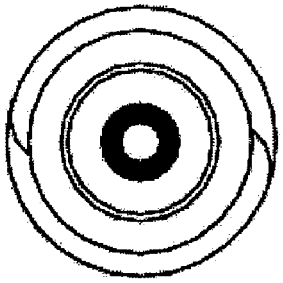
Figure 4:
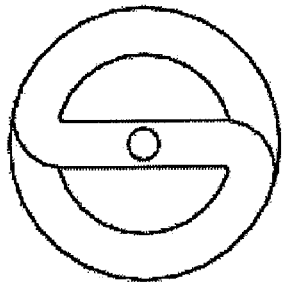
Figure 5:
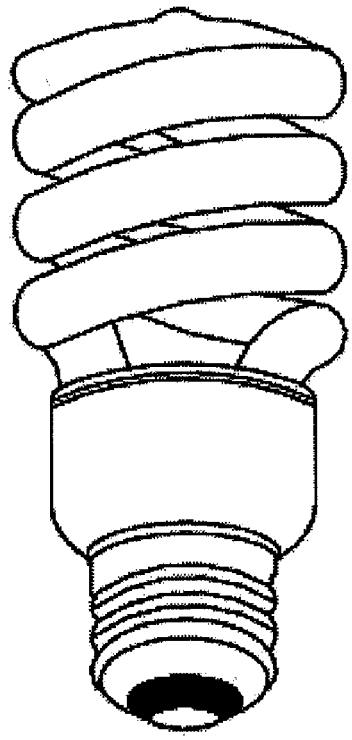
FIG. 5 is the overall view of the design.

1 in FIG. 1 is the lamp base, 2 is the lower part of the plastic housing, 3 is the cover for the plastic housing, 3 is the cover for the plastic housing and 4 is the spiral lamp tube.

Figure 6A:
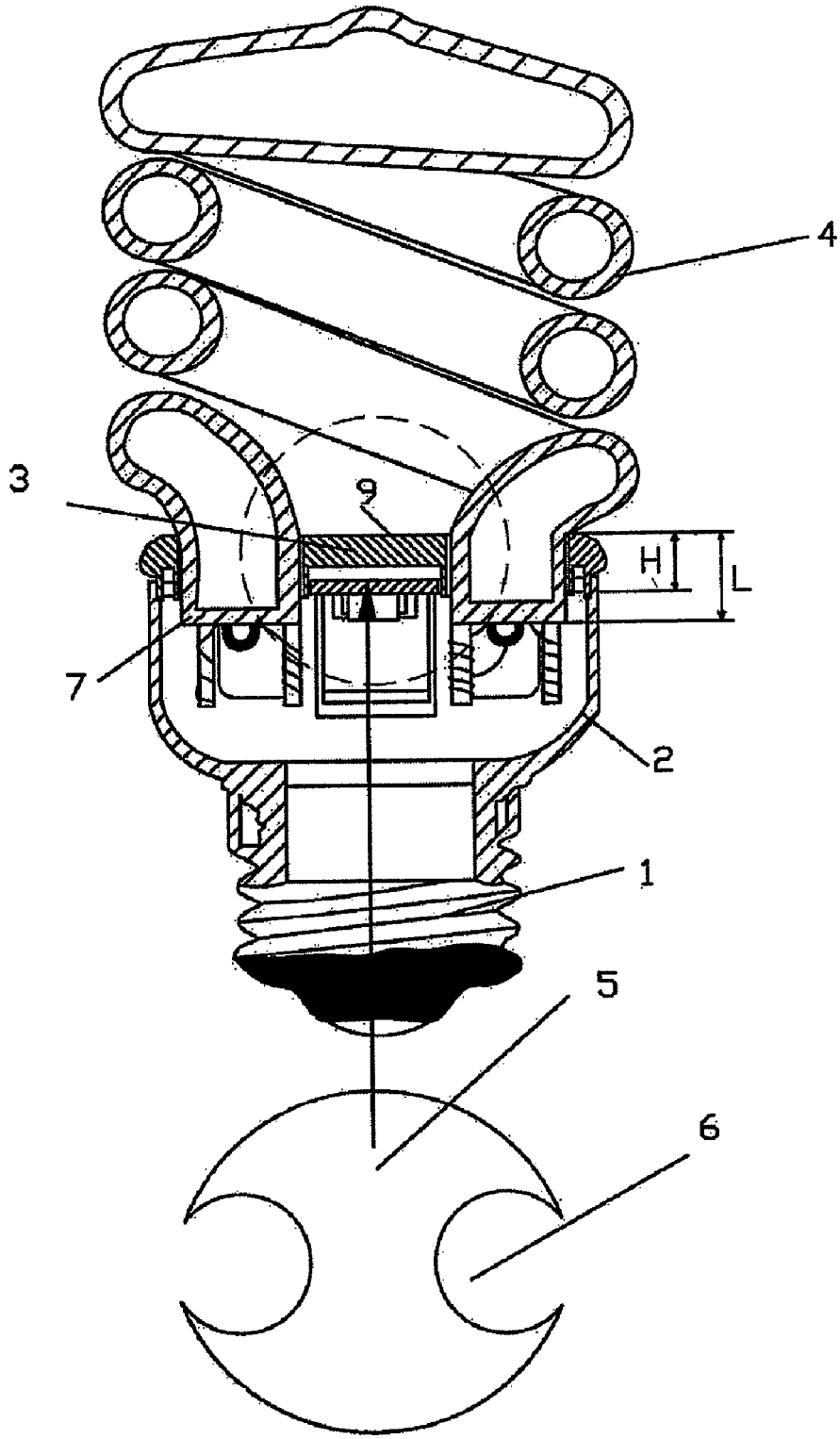
FIG. 6A is a sectional view of this invention and view of the PC Board.

5 in FIG. 6A is the PC Board.

6 in 6A and 6B are the two symmetrical notches on the board.

Figure 6B:
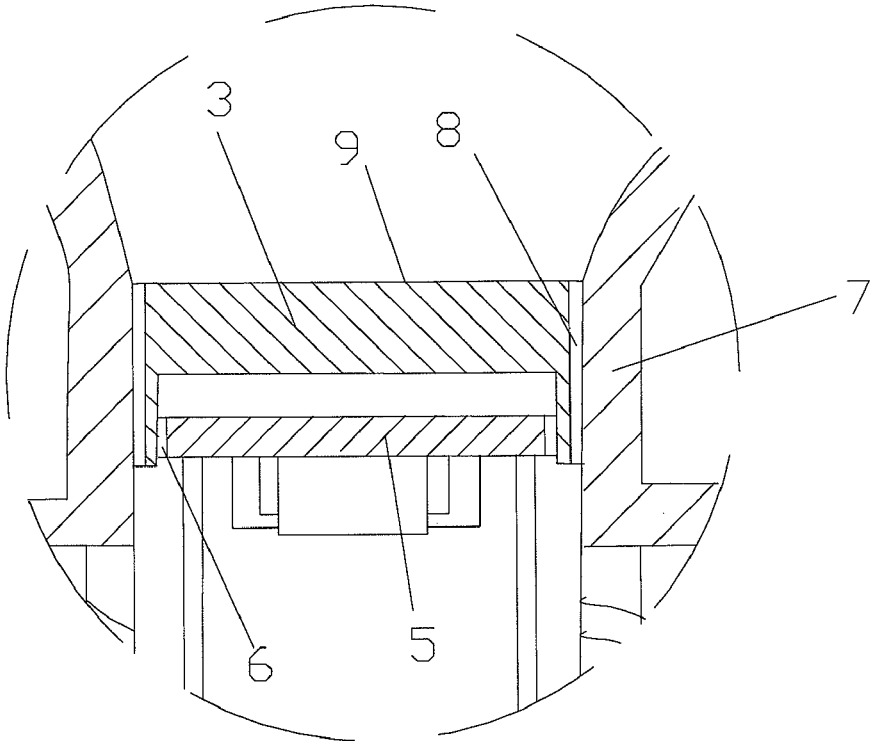
FIG. 6B is an enlarged section view surrounded by a broken line circle.
Figure 7:
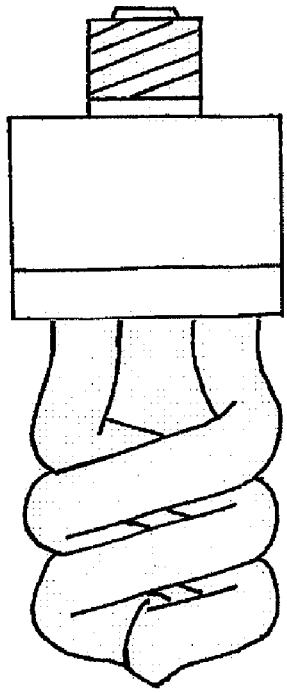
Fig.7 ( Prior Art )
FIG. 7 is a conventional springlamp.

7 in FIGS. 6A and 6B is the straight legs of the tube.

8 in FIG. 6B are two holes on the upper cover of the housing.

9 in FIGS. 6A and 6B is the facing surface of the upper cover for the housing.

H in FIG. 6A is the distance between the PCB in the plastic housing and the facing surface of the upper cover for the housing.

L in FIG. 6A is the length of the straight legs of the tube.

DETAILED DESCRIPTION OF THE INVENTION

For this new practical invention, we only need to put the straight part of the lamp tube through the holes of the plastic housing and the notches on the PCB. The other aspects are the same to the other lamp designs.

What is claimed is:

1. A fluorescent springlamp, which includes a lamp base, a lower part (2) of a plastic housing, an upper cover (3) for the housing, a spiral lamp tube (4), and a PCB (5) placed inside the plastic housing, wherein legs (7) of the tube with filaments in them are straight, wherein there are two holes (8) on the upper cover (3) for the housing and two relative notches (6) on the PCB (5), and wherein the straight legs (7) of the tube are completely placed in the plastic housing.

2. The springlamp of claim 1, wherein a length of the straight legs (7) of the tube is longer than a distance (H) between the PCB (5) in the housing and an upper surface (9) of the upper cover for the housing.

* * * * *